US005451299A

United States Patent [19]

Privett, III et al.

[11] Patent Number: 5,451,299

[45] Date of Patent: Sep. 19, 1995

[54] METHOD FOR REDUCING HYDROGEN ABSORPTION DURING CHEMICAL MILLING

[75] Inventors: Hugh M. Privett, III, Palm Beach Gardens; Henry M. Hodgens, II, Jupiter, both of Fla.

[73] Assignee: The United States of America as represented by the Secretary of the Air Force, Washington, D.C.

[21] Appl. No.: 995,433

[22] Filed: Dec. 23, 1992

[51] Int. Cl.[6] ..... H01L 21/00

[52] U.S. Cl. ..... 204/129.1; 204/129.25; 204/129.4; 204/129.5; 216/100

[58] Field of Search ..... 204/129.1, 129.4, 129.5, 204/129.25, 129.75; 429/40, 57, 58, 59; 156/664, 651

[56] References Cited

U.S. PATENT DOCUMENTS

| | | | |
|---|---|---|---|
| 3,231,428 | 1/1966 | Thompson | 429/40 |
| 3,944,496 | 3/1976 | Coggins et al. | 252/79.3 |
| 4,026,741 | 5/1977 | Chang et al. | 156/650 |
| 4,116,755 | 9/1978 | Coggins et al. | 156/659 |
| 4,563,239 | 1/1986 | Adinolfi et al. | 156/639 |
| 4,820,360 | 4/1989 | Eylon et al. | 148/133 |
| 4,900,398 | 2/1990 | Chen | 156/664 |
| 5,102,499 | 4/1992 | Jodgens et al. | 156/664 |

FOREIGN PATENT DOCUMENTS

| | | |
|---|---|---|
| 55-046567 | 4/1980 | Japan . |
| 59-191315 | 10/1984 | Japan . |
| 61-220335 | 9/1986 | Japan . |
| 63-076440 | 4/1988 | Japan . |

OTHER PUBLICATIONS

"Principles of Instrumental Analysis"; 3rd ed; Skoog; pp. 567–583; ©1971.

"Inorganic Chemistry"; Huheey; ©1978; Harper & Row Publishers; pp. 312–313.

*Primary Examiner*—R. Bruce Breneman

*Assistant Examiner*—George Goudreau

*Attorney, Agent, or Firm*—Donald J. Singer; Thomas C. Stover

[57] ABSTRACT

The invention provides method and apparatus for chemical milling of a metal part in a milling solution that reduces hydrogen absorption by the part wherein, the metal part to be milled, which serves as the anode, and a cathode of more noble metal than the anode, are mounted in such solution. Unlike the prior art, the cathode and anode are separated in such solution but electrically connected by a conductor therebetween, which conductor is insulated from the milling solution. Thus anode and cathode are mounted, spaced apart in the milling solution, so that metal dissolves from the anode surface, milling such part while electrons flow from anode to cathode by said conductor so that hydrogen forms at the cathode, removed from the anode part, to reduce hydrogen absorption by such part.

The anode part can be of, eg. titanium and the cathode of a more noble metal, eg. platinum, which serves to draw the hydrogen to the cathode and away from the anode part, preventing or reducing absorption of hydrogen into, eg. the titanium part and consequent hydrogen embrittlement thereof, which occurs in the prior art.

4 Claims, 2 Drawing Sheets

METHOD FOR REDUCING HYDROGEN ABSORPTION DURING CHEMICAL MILLING

STATEMENT OF GOVERNMENT INTEREST

The invention described herein may be manufactured and used by or for the Government for governmental purposes without the payment of any royalty thereon.

BACKGROUND OF THE INVENTION

1. FIELD OF THE INVENTION

This invention relates to a method for chemical milling of metal parts, particularly milling with reduced hydrogen absorption into such parts.

2. THE PRIOR ART

Chemical milling is a useful and cost effective procedure for removing material from metal parts, eg. aircraft and gas turbine engine parts. In the chemical milling process, a metal part, eg. of an aircraft is typically immersed in an acidic milling solution, which solution can be agitated or flowed across the part for metal removal purposes. Such procedure can be used on a wide variety of alloys.

One of the principal disadvantages of the process is the absorption of hydrogen at the surface of the metal part being milled. This is especially true for titanium alloys. In fact some beta titanium alloys, are so sensitive to hydrogen pick-up that multiple baking cycles must be performed to remove any excess hydrogen.

The reason that such parts absorb hydrogen is as follows. The acids used in the chemical milling solution dissolve the material of the metal part at its surface. When the metal surface material dissolves, it takes on a positive charge. Since electrical neutrality of the milling solution must be maintained, some reaction which balances the positive charge of the metals must take place. In an acidic milling solution, the primary reaction is a formation of hydrogen gas (and/or atomic hydrogen) from the hydrogen ions in the acid solution. The reactions described are shown below:

$$M \rightarrow M^{x+} + xe^-$$

and $$xH^+ + xe^- \rightarrow (x/2)H_2(g)$$

where M is a metal in the alloy and x is the charge, in solution, of the metal M.

When a metal part is immersed in the milling solution, both of the above reactions occur at the metal part surface. It is the cathodic reaction of hydrogen formation that results in hydrogen pick-up by the material. That is, the metal part absorbs hydrogen with consequent hydrogen embrittlement of such part. Such hydrogen embrittlement seriously weakens the metal part and is unacceptable in, eg. thin-section engine parts which need all the strength such metal can provide.

In the prior art, attempts have been made to solve the above metal part hydrogen absorption problem by adding hydrogen suppressant chemicals to the milling acid bath. See for example, U.S. Pat. No. 4,900,398 to Chen (1990) and U.S. Pat. No. 4,116,755 to Coggins (1978). These references disclose coating the metal part surface with hydrogen suppressant chemicals believed to be, eg. an oxide film which inhibits hydrogen absorption into such metal surface but also can impair the metal removal rate from such part.

Accordingly, there is a need and market for a method for reducing hydrogen pick-up by metal part during a chemical milling process, that does not interfere with the metal removal rate and that otherwise substantially obviates the above prior art shortcomings.

There has now been discovered a chemical milling process that does not require the use of hydrogen suppressant or oxide barrier forming chemicals which prevents or reduces absorption of hydrogen into the metal part during chemical milling.

SUMMARY

Broadly the present invention provides a method for chemical milling of metal parts in a milling solution that reduces hydrogen pickup or absorption by said part comprising, a) providing a cathode of a more noble metal than that of the part which serves as the anode herein,
b) connecting the anode part and the cathode by an electric conductor,
c) placing the cathode in the solution and
d) placing the anode part in the solution but at a distance from the cathode such that metal dissolves from the anode surface into the solution, electrons flow from the anode to the cathode in said conductor and hydrogen forms at the cathode removed from the anode part, to reduce hydrogen absorption by the part being milled.

BRIEF DESCRIPTION OF THE DRAWINGS

The invention will become more apparent from the following detailed specification and drawings in which.

DESCRIPTION OF PREFERRED EMBODIMENTS

Figure 1:
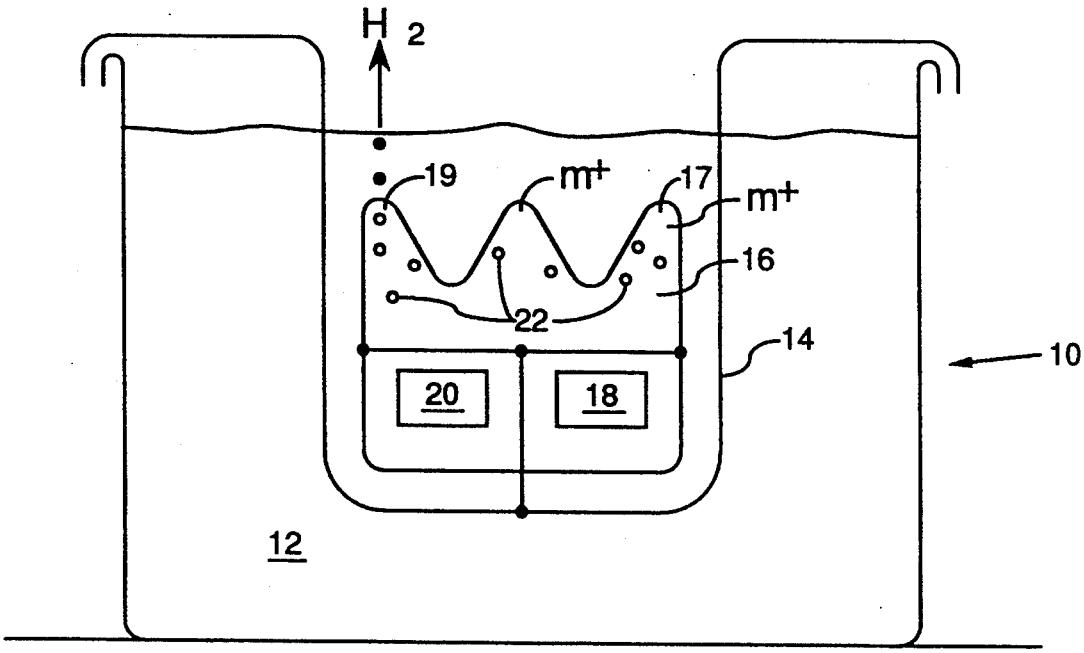
FIG. 1 is a schematic cross-sectional elevation view of a prior art chemical milling process.

Referring in detail to the drawings, container 10 holds chemical milling solution 12 in a prior art milling process as shown in FIG. 1. In such process the metal part 16 has a pair of masks 18 and 20 thereon, which part is immersed in the milling solution in an inert basket 14, as shown in FIG. 1.

In said part 16, node 17 is shown as the anode giving off metal ions to solution while node 19 is shown as the cathode for hydrogen formation at the metal surface. However, in reality, the anode and cathode reactions are interspersed on the part 16, causing formation (of metal ions and) of hydrogen 22 and absorption across the surface of such part and hydrogen embrittlement thereof as noted above. Thus the cathode reaction proceeds on the metal part being milled to its detriment, as noted above.

The cathode reaction can be expressed again as $$2e^- + 2H^+ \rightarrow H_2(g).$$

Figure 2:
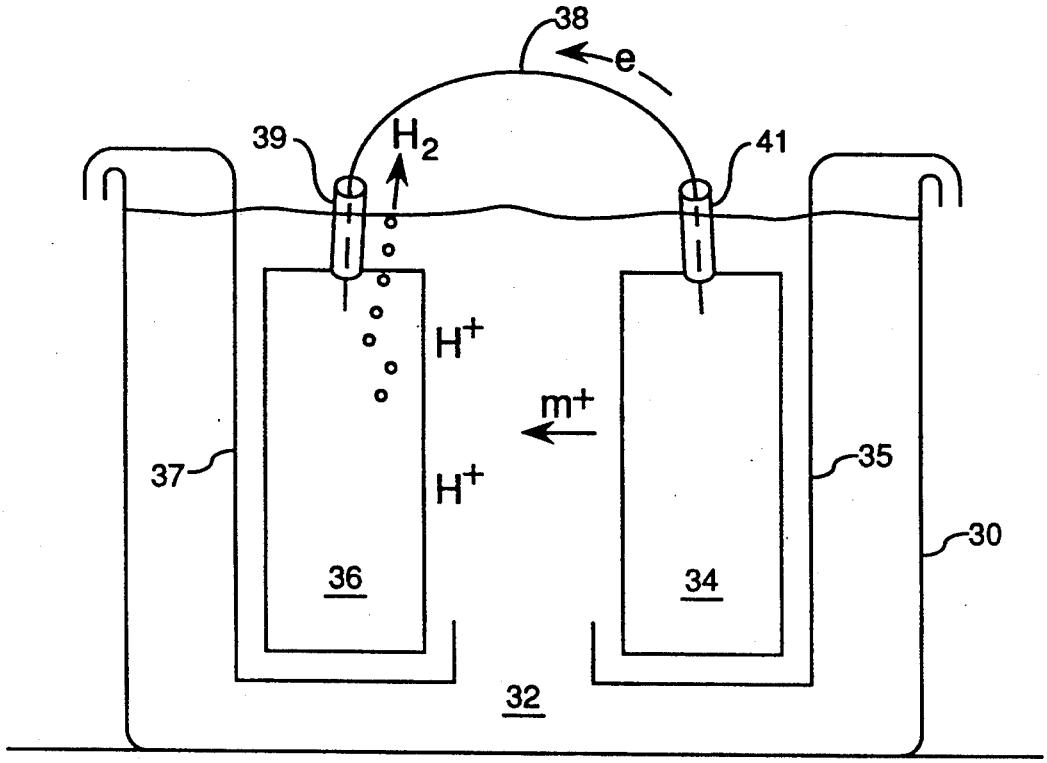
FIG. 2 is a schematic sectional elevation view of a chemical milling process according to the present invention and FIG. 3 is a schematic sectional elevation view of another chemical milling process embodying the invention.

To solve the above hydrogen embrittlement of the part being milled problem, Applicants' inventive process is shown in FIG. 2 wherein container 30 holds chemical milling solution 32, metal part anode 34 and more noble metal cathode, eg. of platinum, 36 as shown in FIG. 2. The anode and cathode are connected by conductive wire 38 and separately supported in such solution at a distance, by inert metal baskets 35 and 37, as shown in FIG. 2.

As indicated, the metal ions flow in solution away from the anode while the electrons flow from anode to cathode through the conductor 38, such that the metal anode part is chemically milled as desired, while hydrogen formation takes place at the cathode, which is removed from the anode, reducing or preventing hydrogen absorption in such metal part being milled, as indicated in FIG. 2.

Figure 3:
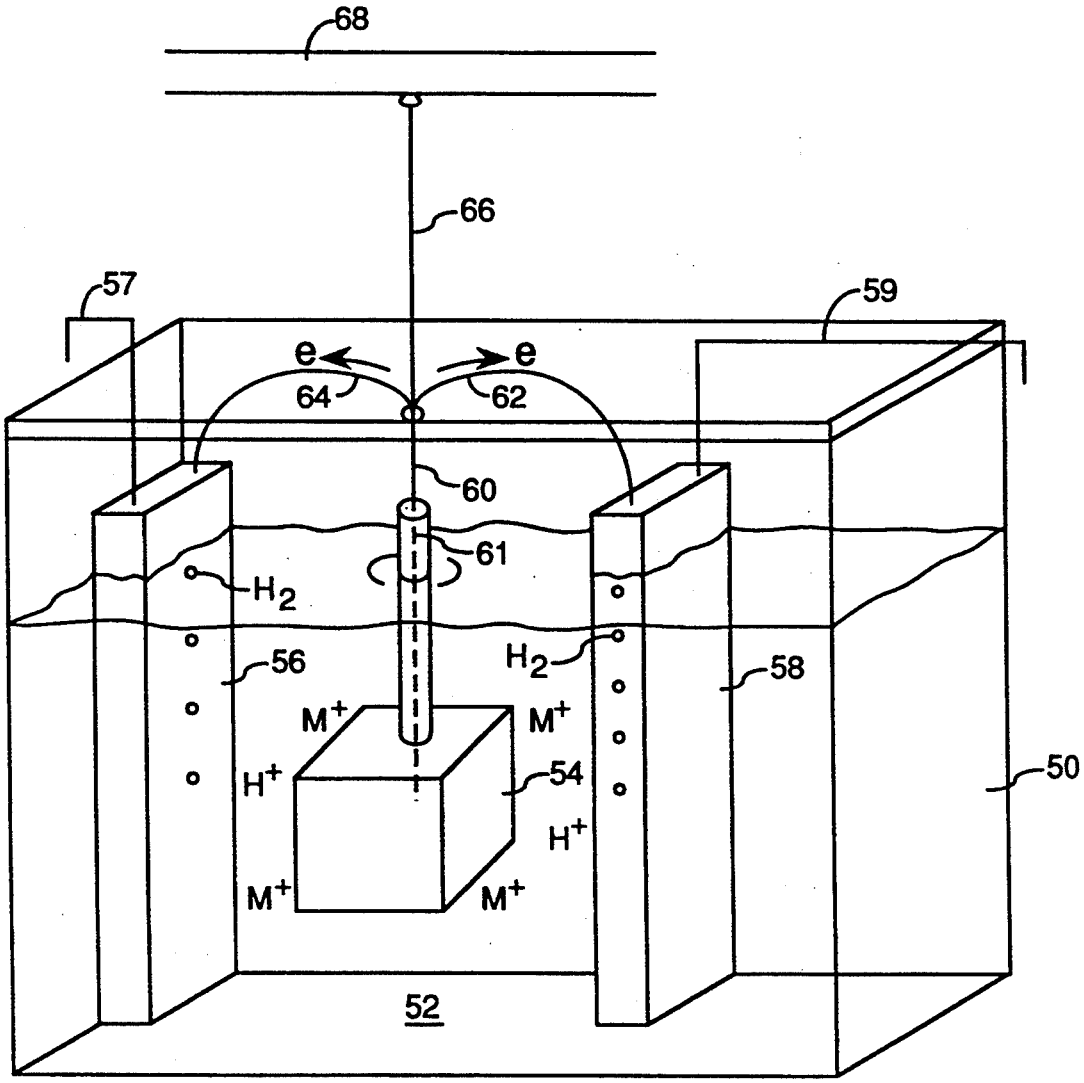

Another embodiment of the invention is shown in FIG. 3 wherein container 50 holds milling solution 52, anode part 54 and a pair of cathodes 56 and 58. As shown, the cathodes 56 and 58 are supported by brackets 57 and 59 respectively, on the container 50, while anode part 54 is supported by conductive wire 60 and wire 66, which connects with support member 68, as shown in FIG. 3. Such anode conductor 60 also electrically connects with conductor 62 to cathode 58 and by conductor 64 to cathode 56, such that the metal ions dissolve in solution from the anode part and electrons flow therefrom by way of conductors 62 and 64 to the outlying cathodes 56 and 68, where hydrogen formation takes place, again removed from the anode part 54 to prevent or reduce hydrogen absorption therein, as indicated in FIG. 3.

As further indicated eg. in FIG. 3, it is desirable that the anode part be completely submerged in the chemical milling solution for complete milling thereof (except of those areas that are masked). However, it is not desirable that the conductor 60 be immersed in the chemical solution as it can be attacked thereby. Thus it is desirable that portion of conductor 60 that enters the solution 52 be insulated therefrom eg. by masking or by a sleeve 61, as shown in FIG. 3.

The conductor's 64 and 62 to the cathodes 56 and 58 need similar insulative protection (to that of conductor 61) if the cathodes be totally submerged in the milling solution 52. However, the cathodes 56 and 58 can extend above the milling solution 52, eg. as shown in FIG. 3, and this meets the insulative requirements for conductors 62 and 64, as they contact their respective cathodes 56 and 58 in air, above the solution 52 as shown in FIG. 3.

Thus, the cathodes as noted above need not be wholly immersed in the milling solution but must be of a more noble metal and of sufficient size and number to meet the ion flow requirements of the metal ions from the anode. Thus in a preferred embodiment, indicated in FIG. 3, the noble metal cathodes can surround the anode part 54 so as to define a vertically segmented cylinder like structure.

As noted above, the cathode is of a more noble metal than the anode part. For example, if the anode part be of titanium or titanium alloy, the cathode is desirably of, eg. platinum. In other examples, the cathode can be of, eg. the noble metals of Group VIII A of the Periodic Table of the Elements (as is Platinum), such as Palladium, Rhodium, Iridium as well as other noble metals such as Gold. In addition to a single element, the cathode can be an alloy or a coating of a noble metal or alloy on a substrate.

The anodes can be supported in various ways in the chemical milling solution, eg. by inert baskets, hooks, brackets, conductors and the like within the scope of the invention.

The milling solution can be any of various milling solutions presently known in the art, including an acidic conductive aqueous solution conventionally used in chemical milling of metal parts, eg. a nitric-hydrofluoric acid solution.

Desirably the cathode or cathodes are placed at a distance from the anode part but in relative close proximity therewith consistent with avoiding or reducing hydrogen absorption in the anode part. That is, the separation between anode and cathode can be eg. 0.01 to 36 inches or more and often is between 0.3 to 6.0 inches depending on the properties of anode, cathode and milling solution and the temperature thereof.

Thus the invention provides method and apparatus for preventing or reducing hydrogen absorption in the anode part by employing a cathode separate from the anode part instead of employing the normal configuration in which anode and cathode are part of the same object and surface, with anode and cathode reactions interspersed thereon. As noted above, the cathode is desirably made of a more noble material than a material to be milled, ie. a cathode material that receives electrons more spontaneously than the anode part. A typical cathode would be of platinum as noted above. The cathode is then electrically connected to the anode part. The cathode as noted above should be preferably immersed in the milling solution first. The part is then immersed and continues to function as the anode and dissolves into the acid solution but now the separate cathode becomes the site for hydrogen formation, as noted above, since the electron transfer occurs through the conductor between anode and cathode. This keeps the hydrogen removed from the anode part, eliminating or substantially reducing the hydrogen pickup by such part.

The anode to cathode surface area ratio for effective reduction of Hydrogen absorption at the anode, will depend upon the speed of the reaction and the electrical conductivity of the anode and cathode.

As noted above it is important to keep anode and cathode separated so as to have the hydrogen formation at the cathode sufficiently removed from the anode part to avoid or minimize absorption of hydrogen into such anode part. At the same time, there is a resistance in the milling solution for metal ion flow from anode to cathode and thus it is desirable to have the anode part and cathode in sufficiently close proximity for good conductivity and ion flow but sufficiently separated to keep the hydrogen emanating from the cathode, away from the anode part, as discussed above. Thus for an anode part of one cubic foot, the cathodes are desirably spaced from the anode in the milling solution, a distance of, eg. 3 in.

The metal anode part chemically milled per the method of the invention can be various metal parts, eg. structural parts for vehicles of land, water, air and space including aircraft engine parts, eg. parts of gas turbine engines, as well as aircraft parts and also for stationary structures such as buildings, towers and the like.

What is claimed is:

1. A method for chemical milling of a metal part in a milling solution that reduces hydrogen absorption by said part comprising, a) selecting said metal part from the group consisting of titanium and titanium alloy and having said metal part serve as an anode, b) providing a cathode of a more noble metal than said anode, c) connecting said anode and said cathode by an electric conductor that is insulated from the milling solution, d) placing said cathode in said solution and e) placing said anode in said solution but at a distance from said cathode such that metal dissolves from the anode surface into solution and the electrons flow from anode to cathode through said conductor and hydrogen forms at said cathode, removed from said anode, to reduce hydrogen absorption by said metal part.

2. The method of claim 1 wherein said anode part is of a metal selected from the group consisting of titanium and titanium alloy and the cathode is a metal selected from the group consisting of platinum, palladium, rhodium, iridium and gold.

3. The method of claim 1 wherein said anode is placed in said solution between a plurality of spaced cathodes.

4. The method of claim 1 wherein said solution is an acidic conductive aqueous solution.

* * * * *